US007006784B2

(12) United States Patent
Ikeda et al.

(10) Patent No.: US 7,006,784 B2
(45) Date of Patent: Feb. 28, 2006

(54) IMAGE FORMING APPARATUS AND TONER STIRRING METHOD

(75) Inventors: Takashi Ikeda, Shizuoka-ken (JP); Susumu Nomura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 49 days.

(21) Appl. No.: 10/802,046

(22) Filed: Mar. 17, 2004

(65) Prior Publication Data

US 2005/0207792 A1 Sep. 22, 2005

(51) Int. Cl.
*G03G 15/08* (2006.01)
*G03G 21/10* (2006.01)

(52) U.S. Cl. ..... 399/359; 399/254

(58) Field of Classification Search ..... 399/254, 399/359, 358, 255

See application file for complete search history.

(56) References Cited

U.S. PATENT DOCUMENTS 5,881,345 A * 3/1999 Yamane et al. ..... 399/255
5,887,224 A * 3/1999 Mizuishi et al. ..... 399/62
5,995,799 A * 11/1999 Nagashima et al. ..... 399/359
6,611,672 B1 * 8/2003 Aoki et al. ..... 399/359
6,721,534 B1 * 4/2004 Takahashi ..... 399/359
6,829,461 B1 * 12/2004 Arai et al. ..... 399/253
6,892,045 B1 * 5/2005 Tokimatsu et al. ..... 399/359
2004/0265009 A1 * 12/2004 Shigeta et al. ..... 399/254
2005/0111883 A1 * 5/2005 Amano et al. ..... 399/254

FOREIGN PATENT DOCUMENTS

EP 0689105 A2 * 12/1995
JP 2000-338836 A 12/2000
JP 2001249545 A * 9/2001

OTHER PUBLICATIONS

U.S. Appl. No. 10/802,047, filed Mar. 17, 2004, Ikeda et al.

* cited by examiner

*Primary Examiner*—Christopher W. Fulton
(74) *Attorney, Agent, or Firm*—Foley & Lardner LLP

(57) ABSTRACT

In an image forming apparatus, the distance of stirring and conveyance of recycle toner that is recovered from a photosensitive drum is made greater than the distance of stirring and conveyance of fresh toner. It is thus possible to prevent non-charged toner from being supplied to the photosensitive drum.

6 Claims, 6 Drawing Sheets

IMAGE FORMING APPARATUS AND TONER STIRRING METHOD

BACKGROUND OF THE INVENTION

1. Field of the Invention

The present invention relates to an image forming apparatus that forms an image using a developer.

2. Description of the Related Art

In an image forming apparatus that forms an image using, e.g. a developer including a toner, an electro-static latent image is formed on a photosensitive drum that serves as an image carrying body. The electro-static latent image is developed by a developer unit, and a developed toner image is transferred to paper by a transfer unit. The transferred toner image is fixed on the paper by a fuser.

There is known an image forming apparatus of this kind, wherein toner, which remains on the photoconductive drum after the toner image is transferred to the paper, is removed and recovered by a cleaning device. The recovered toner (hereinafter referred to as "recycle toner") is reused.

For example, a toner recycle mechanism is known. According to this mechanism, recycle toner, which is conveyed by a recovery mixer that is provided in a cleaning device, is directly brought back into the developer unit by a coupling mixer that is provided between the cleaning device and the developer unit.

In this case, the recovered toner is always supplied to the developer unit while the recovery mixer and the coupling mixer are being rotated.

As regards the recycle toner to be reused, there are problems: external additive that is inherently provided on toner particles is partly removed, external additive that is removed from other toner particles may adhere to recycle toner, or paper dust is mixed in recycle toner. Compared to fresh toner, the amount of external additive of which is properly set, an initial rise in charge amount of the recycle toner is not good. If frictional charge that is provided by stirring is deficient, toner that is not charged may be fed to the photosensitive drum.

If the non-charged toner is transferred to paper via the photosensitive drum, such problems as fogging of image or dispersion of toner would occur.

BRIEF SUMMARY OF THE INVENTION

According to an aspect of the present invention, there is provided an image forming apparatus comprising: a first chamber including a first mixer disposed in a direction that coincides with an axial direction of an image carrying body which carries an electrostatic latent image, the first mixer stirring and conveying a developer containing at least a toner in a first direction and supplying the toner, which is charged with a predetermined potential, to the image carrying body; a second chamber including a second mixer disposed in parallel to the first mixer, the second mixer stirring and conveying the developer in the first direction and applying a predetermined potential to the toner; a third chamber disposed between the first chamber and the second chamber and including a third mixer disposed in parallel to the first mixer and the second mixer, the third mixer stirring and conveying the developer, which is received from downstream sides of the first and second chambers, in a second direction different from the first direction, and guiding the toner, which is charged with a predetermined potential, to at least an upstream side of the first chamber; a recycle toner supply section that is disposed on an upstream side of the second chamber and is supplied with a toner recovered from a surface of the image carrying body; and a fresh toner supply section that is disposed on an upstream side of the third chamber and is supplied with a fresh toner.

According to another aspect of the present invention, there is provided an image forming apparatus comprising: a fresh toner supply mechanism that supplies a fresh toner; a recycle toner supply mechanism that supplies a toner recovered from a surface of an image carrying body; stirring means for stirring the fresh toner, which is supplied from the fresh toner supply mechanism, along a first convey path with a first length, and stirring the recycle toner, which is supplied from the recycle toner supply mechanism, along a second convey path with a second length that is greater than the first length; and the second convey path including the first convey path.

According to further another aspect of the present invention, there is provided a toner stirring method comprising: supplying a recycle toner, which is recovered from a surface of an image carrying body, to a recycle toner supply section; stirring and conveying a fresh toner, which is supplied to a fresh toner supply section, along a first convey path with a first length, and applying a predetermined potential to the fresh toner that is conveyed to a confluence part; stirring and conveying the recycle toner, which is supplied to the recycle toner supply section, along a second convey path with a second length greater than the first length, and applying a predetermined potential to the recycle toner that is conveyed to the confluence part; and supplying the recycle toner and the fresh toner, which are conveyed to the confluence part, to the surface of the image carrying body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION (First Embodiment)

An image forming apparatus according to an embodiment of the present invention will now be described with reference to the accompanying drawings.

Figure 1:
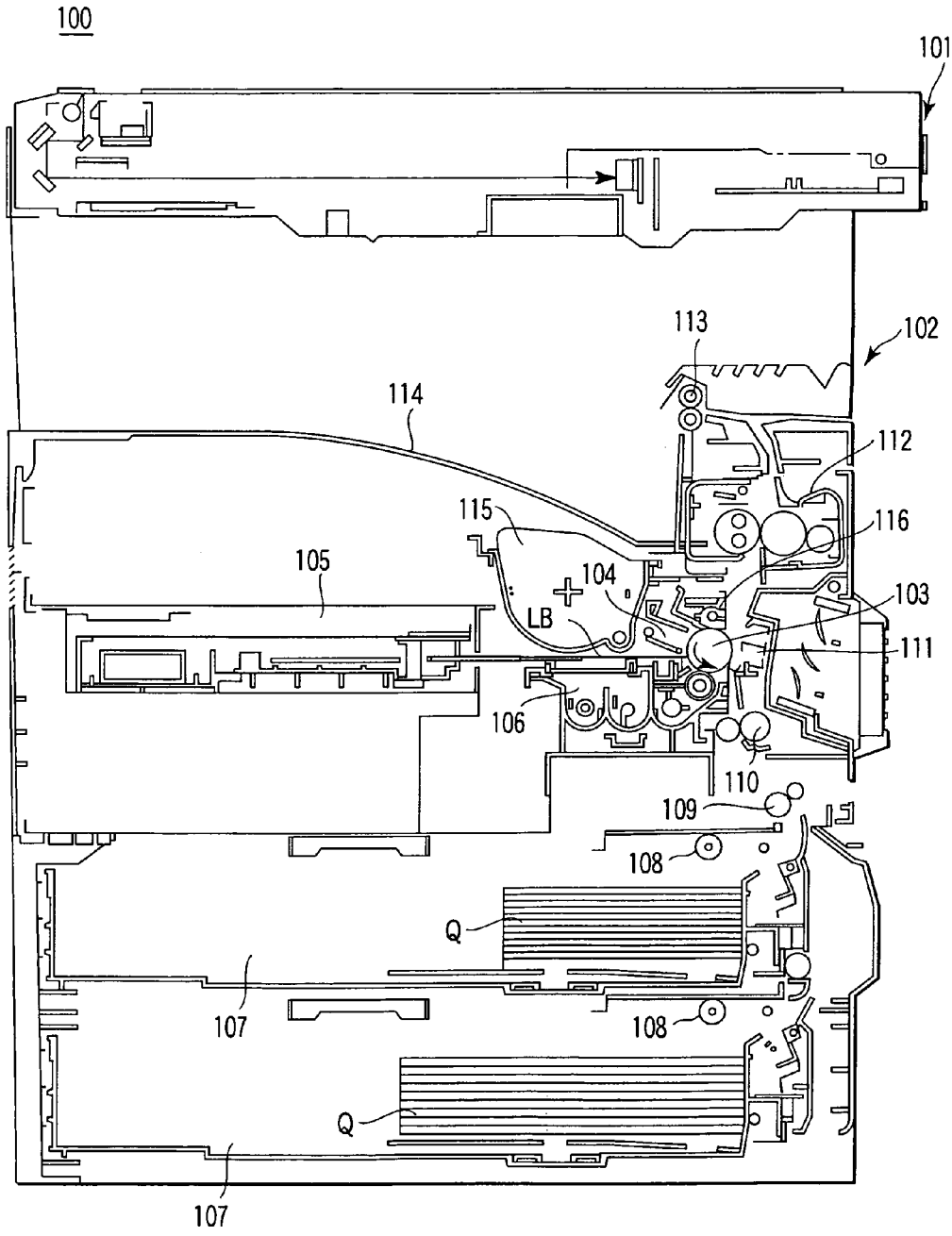
FIG. 1 schematically shows an image forming apparatus according to an embodiment of the present invention.

FIG. 1 is a schematic front view of the image forming apparatus, with the cover being removed.

As is shown in FIG. 1, an image forming apparatus (digital copying machine) 100 includes an image scanning section (scanner) 101, which reads an image on a to-be-scanned or to-be-copied object (original) P and produces an image signal, and an image forming section 102, which forms an image based on the image signal produced from the scanner 101 or an image signal that is provided from outside.

The image forming section 102 includes a photosensitive drum 103, a charger 104, an exposing device 105, a developer unit 106, sheet cassettes 107, pickup rollers 108, a convey roller 109, an aligning roller 110, a transfer device 111, a fuser 112, an output roller 113, an output tray 114, a fresh toner supply device 115, and a photosensitive drum cleaner 116.

The photosensitive drum 103 has a photosensitive body on its outer periphery. The photosensitive body is illuminated in the state in which a predetermined potential is applied thereto. The potential of the illuminated region varies, and an electrostatic latent image, which is formed by the variation in potential, is retained on the photosensitive body for a predetermined time period.

The charger 104 charges the surface of the photosensitive drum 103 with a predetermined potential.

The exposing device 105 is disposed on a downstream side of the charger 104 in the rotational direction of the photosensitive drum 103. The exposing device 105 applies a laser beam LB, which has a light intensity varying in accordance with the image signal supplied from the scanner 101, to the photosensitive drum 103. The laser beam LB can have a predetermined light intensity corresponding to, e.g. the density of an image.

The developer unit 106 is disposed on the downstream side of the exposing device 105 in the rotational direction of the photosensitive drum 103. The developer unit 106 contains a two-component developer that comprises a carrier and a toner. The developer unit feeds developer (e.g. toner) to the surface of the photosensitive drum 103, thereby developing an electrostatic latent image on the surface of photosensitive drum 103 into a visible toner image.

Each sheet cassette 107 contains paper sheets Q, and the pickup roller 108 picks up them one by one. The picked-up sheet is conveyed to the aligning roller 110 by means of the convey roller 109.

The aligning roller 110 rotates at a predetermined timing and conveys the sheet Q to the position for image transfer, thereby to register the positions of the sheet Q and the toner image formed on the photosensitive drum 103.

The transfer device 111 applies a predetermined potential to the paper sheet Q and transfers the toner image formed on the photosensitive drum 103 to the sheet Q.

The fuser 112 applies predetermined heat and pressure to the sheet Q on which the toner image is formed, and fuses the toner image and fixes it on the sheet Q.

The output roller 113 conveys the sheet Q that is output from the fuser 112 to the output tray 114.

The fresh toner supply device 115 supplies fresh toner, which has not been used for image formation, to the developer unit 106 at a predetermined timing.

The photosensitive drum cleaner 116 is disposed on a downstream side of the transfer position, where the transfer device 111 faces the photosensitive drum 103, in the rotational direction of the photosensitive drum 103. The photosensitive drum cleaner 116 recovers toner, or the like, which adheres to the surface of the photosensitive drum 103.

Figure 2:
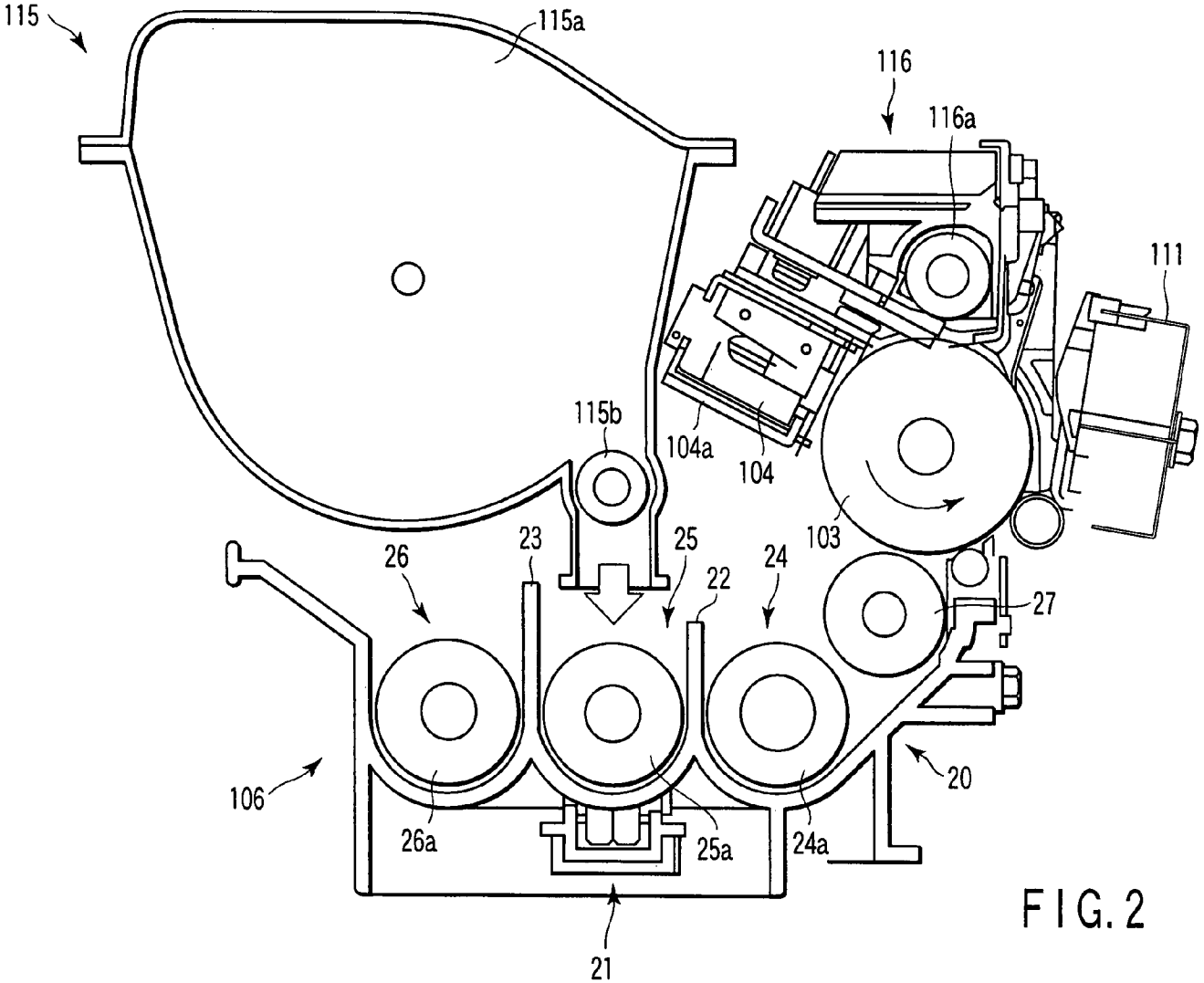
FIG. 2 schematically shows a developer unit and its peripheral components, which are mounted in the image forming apparatus shown in FIG. 1.
Figure 3:
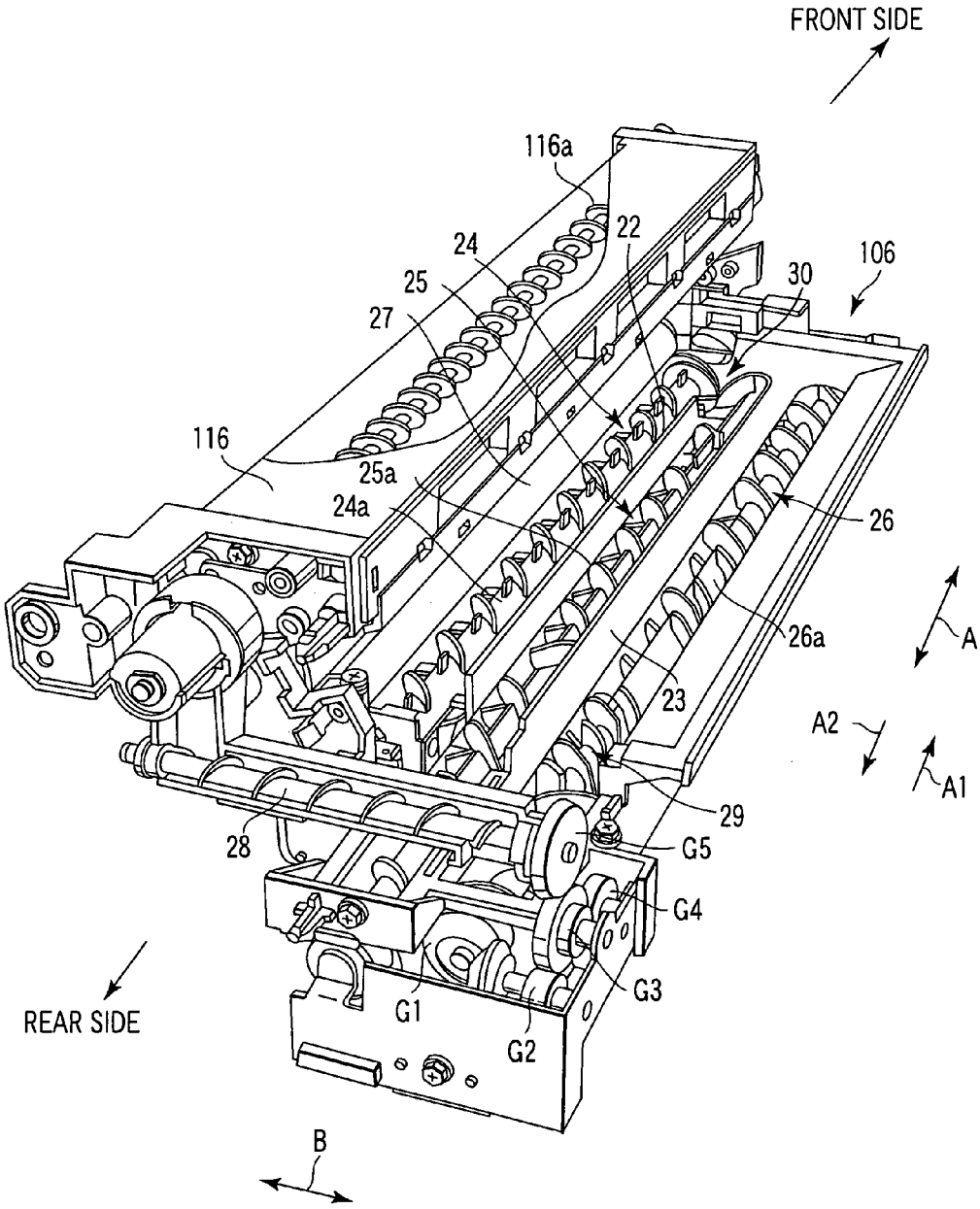
FIG. 3 illustrates the developer unit that is disposed in the image forming apparatus shown in FIG. 1.

FIG. 2 is a cross-sectional view that schematically shows the developer unit, as viewed from the front side in the longitudinal direction of the developer unit, or the vicinity of the end parts of mixers. FIG. 3 is a schematic perspective view of the developer unit.

As is shown in FIG. 2, the developer unit 106 includes the fresh toner supply device 115 and is disposed to be opposed to the photosensitive drum 103 at a predetermined position. The charger 104 and a charge erase lamp 104*a* are arranged on the upstream side of the position for development, where the photosensitive drum 103 faces the developer unit, in the rotational direction of the photosensitive drum 103. On the downstream side of the position for development, the transfer device 111 and photosensitive drum cleaner 116 are arranged in the named order.

The fresh toner supply device 115 includes a fresh toner cartridge 115*a* that contains fresh toner, and a supply roller 115*b* that is rotated by a fresh toner motor 57 (see FIG. 4) at a predetermined timing and supplies fresh toner to a predetermined position in a second chamber 25.

The photosensitive drum 116 includes a recycle toner convey roller 116*a* that conveys recovered recycle toner to the rear side.

The developer unit 106 includes a developer container 20 that contains a two-component developer (hereinafter referred to as "developer") that comprises a carrier and a toner, and a magnetic sensor 21 that detects the concentration of toner contained in the developer container 20. The magnetic sensor 21 should preferably be disposed at a lower part of the developer container 20.

The developer container 20 is partitioned by a first partition 22 and a second partition 23, each having a predetermined length in the axial direction of the photosensitive drum 103, and comprises a first chamber 24, the second chamber 25 and a third chamber 26. The first partition 22 has such a predetermined length that the first chamber 24 and second chamber 25 are coupled at the rear and front sides. The second partition 23 has such a predetermined length that the second chamber 25 and third chamber 26 are coupled at the rear and front sides (see FIG. 5).

The first chamber 24 includes a first mixer 24*a* that has an axis parallel to an axial direction A (see FIG. 3) of the photosensitive drum 103. The second chamber 25 includes a second mixer 25*a* that has an axis parallel to the axial direction A of the photosensitive drum 103. The third chamber 26 includes a third mixer 26*a* that has an axis parallel to the axial direction A of the photosensitive drum 103. A developing roller 27 is rotatably provided in the first chamber 24. The developing roller 27 is opposed to the surface of the photosensitive drum 103 at a position for development, and supplies developer (toner) to the drum 103.

As is shown in FIG. 3, the first mixer 24*a* is rotated to stir and convey the developer in the first chamber 24 at a first speed in a first direction A1 from the rear side to the front side.

The second mixer 25*a* is rotated to stir and convey the developer in the second chamber 25 at a second speed in a second direction A2 from the front side to the rear side.

The third mixer 26*a* is rotated to stir and convey the developer in the third chamber 26 at a third speed in the first direction A1 from the rear side to the front side.

A recycle toner supply mechanism 28 is disposed on the rear side of the developer unit 106. The recycle toner supply mechanism 28 conveys recycle toner, which is supplied by the recycle toner convey roller 116*a* of the photosensitive drum cleaner 116, to the third chamber 26.

The recycle toner supply mechanism 28 has an axis in a direction B that is preset, e.g. in relation to the axial direction A of the photosensitive drum 103. The recycle toner supply mechanism 28 is a mixer that is provided with helical blades and is able to convey recycle toner by rotational motion.

The recycle toner from the recycle toner supply mechanism 28 is fed to a recycle toner supply section 29 that is located on the rear side of the third chamber 26. Specifically, the recycle toner supply section 29 is located on the upstream side of the developer (comprising toner and carrier) that is moved in the first direction A1 in the third chamber 26 by the rotation of the third mixer 26*a*.

A fresh toner supply section 30 is provided on the front side of the second chamber 25, that is, on a side opposite to the rear side in the axial direction A of photosensitive drum 103 where the recycle toner supply section 29 is located. Fresh toner from the fresh toner supply device 115 is brought to the fresh toner supply section 30. Specifically, the fresh toner supply section 30 is located on the upstream side of developer (comprising toner and carrier) that is moved in the second direction A2 in the second chamber 25 by the rotation of the second mixer 25*a*.

The third mixer 26*a* stirs and conveys the recycle toner, which is received from the recycle toner supply mechanism 28, and the developer, which is received from the second mixer 25*a*, and delivers them again to the second mixer 25*a*.

The second mixer 25*a* stirs and conveys the developer, which is received from the third mixer 26*a* and first mixer 24*a*, and the fresh toner, which is received from the fresh toner supply device 115, and delivers them to the first mixer 24*a* and third mixer 26*a*.

The first mixer 24*a* stirs and conveys the developer, which is received from the second mixer 25*a*, and delivers it to the developing roller 27. In addition, the first mixer 24*a* delivers developer, which is removed from the developing roller 27 after development, to the second mixer 25*a*.

A gear G5 is coupled to one end portion of a center shaft of the recycle toner supply mechanism 28. The gear G5 is engaged with a gear G1, which is coupled to the rear-end portion of a center shaft of the third mixer 26*a*, via a gear G2 that is meshed with the gear G1 as well as gears G3 and G4. The recycle toner supply mechanism 28 is rotated by a torque that is transmitted from a main motor 55 (see FIG. 4). Although not shown, the gears G2, G3 and G4 should preferably be coupled to the photosensitive drum 103, recycle toner convey roller 116*a* and first to third mixers 24*a* to 26*a*. More than three gears may be substituted fro the gears G2, G3 and G4.

Hence, the photosensitive drum 103, recycle toner convey roller 116*a*, first to third mixers 24*a* to 26*a* and recycle toner supply mechanism 28, which are coupled by the gears G1 to G5, can be rotated at the same time by the rotation of the main motor.

In the second chamber 25, the magnetic sensor 21 is disposed on the downstream side of the fresh toner supply section 30 in the direction of movement of the developer.

Figure 4:
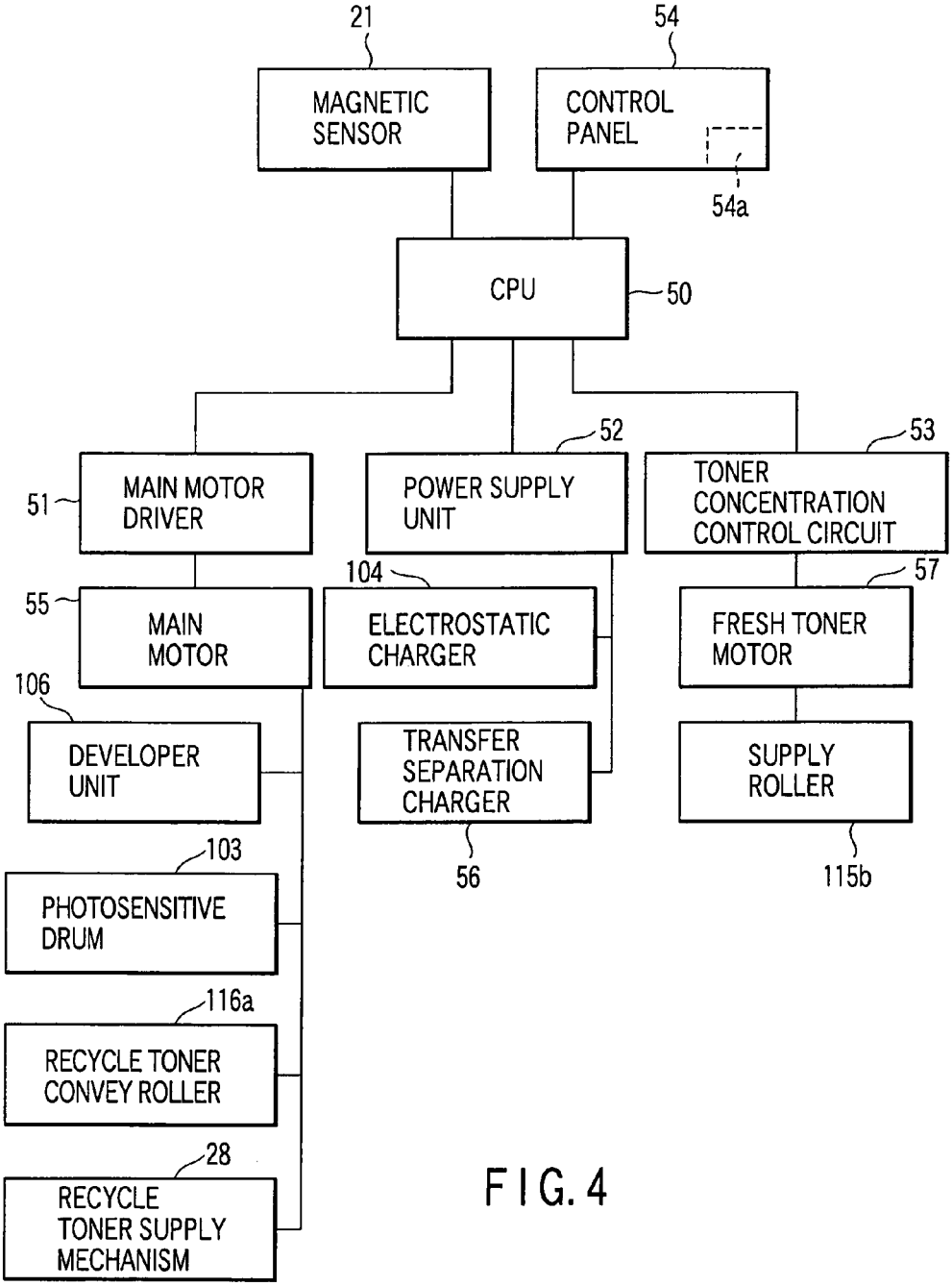
FIG. 4 is a block diagram illustrating a control system of an image forming section shown in FIG. 1.

FIG. 4 is a block diagram illustrating a control system of the image forming section 102 shown in FIG. 1.

As is shown in FIG. 4, a CPU 50 is connected to a main motor driver 51, a power supply unit 52, a toner concentration control circuit 53, a control panel 54 and the magnetic sensor 21.

The control panel 54 includes a display section 54*a*, through which a user instructs predetermined operations. For example, the user instructs image scan by the scanner 101, image formation by the image forming section 102, or both of image scan and image formation.

The magnetic sensor 21 detects, as a toner concentration, the ratio of toner (e.g. resin) to carrier (e.g. iron or ferrite), which are contained in the developer container 20 of the developer unit 106. The magnetic sensor 21 outputs a detection value to the CPU 50. The CPU 50 compares the detection value of toner concentration from the magnetic sensor 21 with a predetermined reference value. If the detection value is lower, the CPU 50 outputs a toner supply signal to the toner concentration control circuit 53. To be more specific, the CPU 50 outputs to the toner concentration control circuit 53 such a toner supply signal as to supply toner for a predetermined time period in accordance with the level of a voltage that is input from the magnetic sensor 21. This level of voltage is representative of the toner concentration.

The main motor driver 51 is connected to the main motor 55. Upon receiving an image formation instruction from the control panel 54, the main motor driver 51 outputs to a drive signal to the main motor 55.

The main motor 55 is coupled to the first to third mixers 24*a* to 26*a* and developing roller 27 of the developer unit 106, the photosensitive drum 103, the recycle toner convey roller 116*a* and the recycle toner supply mechanism 28. Upon receiving the drive signal from the main motor driver 51, the main motor 55 applies a predetermined drive force.

The power supply unit 52 is connected to the charger 104 and a transfer separation charger 56. Upon receiving an image scan instruction from the control panel 54, the power supply unit 52 produces a predetermined voltage after a predetermined elapsed time or immediately.

The charger 104 is supplied with a predetermined voltage from the power supply unit 52 and applies a predetermined charge to the surface of the photosensitive drum 103.

The toner concentration control circuit 53 is connected to the fresh toner motor 57. Upon receiving a toner supply signal from the CPU 50, the fresh toner motor 57 operates only for a predetermined time period.

The fresh toner motor 57 drives the supply roller 115*b*, which is controlled by the toner concentration control circuit 53, thereby supplying a predetermined amount of fresh toner to the fresh toner supply section 30.

In short, the supply amount of fresh toner can be determined in accordance with the level of toner concentration in the developer container 20. For example, if the toner concentration considerably decreases, the supply time of fresh toner becomes longer.

The operation of the image forming apparatus 100 will now be described. In this embodiment, image formation is performed using a reverse development method.

Assume that both image scan and image formation have been instructed through the control panel 54. In this case, the scanner 101 starts image scan. In the image forming section 102, the power supply unit 52 outputs a predetermined voltage and causes the charger 104 to apply charge. Since the image formation is instructed at the same time, the main motor driver 51 outputs a drive signal to the main motor 55.

The scanner 101 includes, for instance, a light source, a lens and a charge-coupled device (CCD). Reflective light from a to-be-copied object is focused on a light-receiving surface of the CCD via the lens. The CCD photoelectrically converts the reflective light to an image signal. The obtained image signal is output to the exposing device 105 and converted to a laser beam LB with a predetermined light intensity.

The laser beam LB is applied to the surface of the photosensitive drum 103, which has been uniformly electrified with a negative charge by the charger 104. The potential of that part of the surface of the photosensitive drum 103, which has been illuminated with the laser beam LB, decreases close to zero. Hence, an electrostatic latent image is formed on the surface of the photosensitive drum 103.

Negatively charged toner in the developer unit 106 is attracted to the latent image on the surface of the photosensitive drum 103, which has been illuminated with the laser beam LB so as to have a predetermined potential level. Thus, a toner image is formed on the surface of the photosensitive drum 103.

The toner image is transferred to a paper sheet Q that is conveyed by the aligning roller 110 to the position for transfer and is positively charged by the transfer device 111.

The toner image that is transferred to the paper sheet Q is fused and fixed by the fuser 112. In short, an image is formed on the paper sheet Q.

The paper sheet Q, on which the image is formed by the fuser 112, is discharged to the output tray 114 by the output roller 113.

On the other hand, the toner, which has not been transferred from the surface of the photosensitive drum 103 and has moved to the photosensitive drum cleaner 116, is recovered by the photosensitive drum cleaner 116.

The recovered recycle toner is collected to the rear side by the recycle toner convey roller 116*a*. The collected recycle toner is brought to the recycle toner supply section 29 via the recycle toner supply mechanism 28. Thus, the recycle toner is reused. On the other hand, if a decrease in toner concentration within the developer container 20 is detected by the magnetic sensor 21, the toner density control circuit 53 drives the fresh toner motor 57 for a predetermined time period (i.e. by a predetermined number of rotations), thereby supplying fresh toner to the fresh toner supply section 30.

If the toner concentration that is detected by the magnetic sensor 21 does not increase even if the toner concentration control circuit 53 outputs the drive signal for a predetermined time period or more and drives the supply roller 115*b*, the display section 54*a* displays such indication that the fresh toner within the fresh toner cartridge 115*a* has been consumed, thus notifying the user of the runout of toner.

Figure 5:
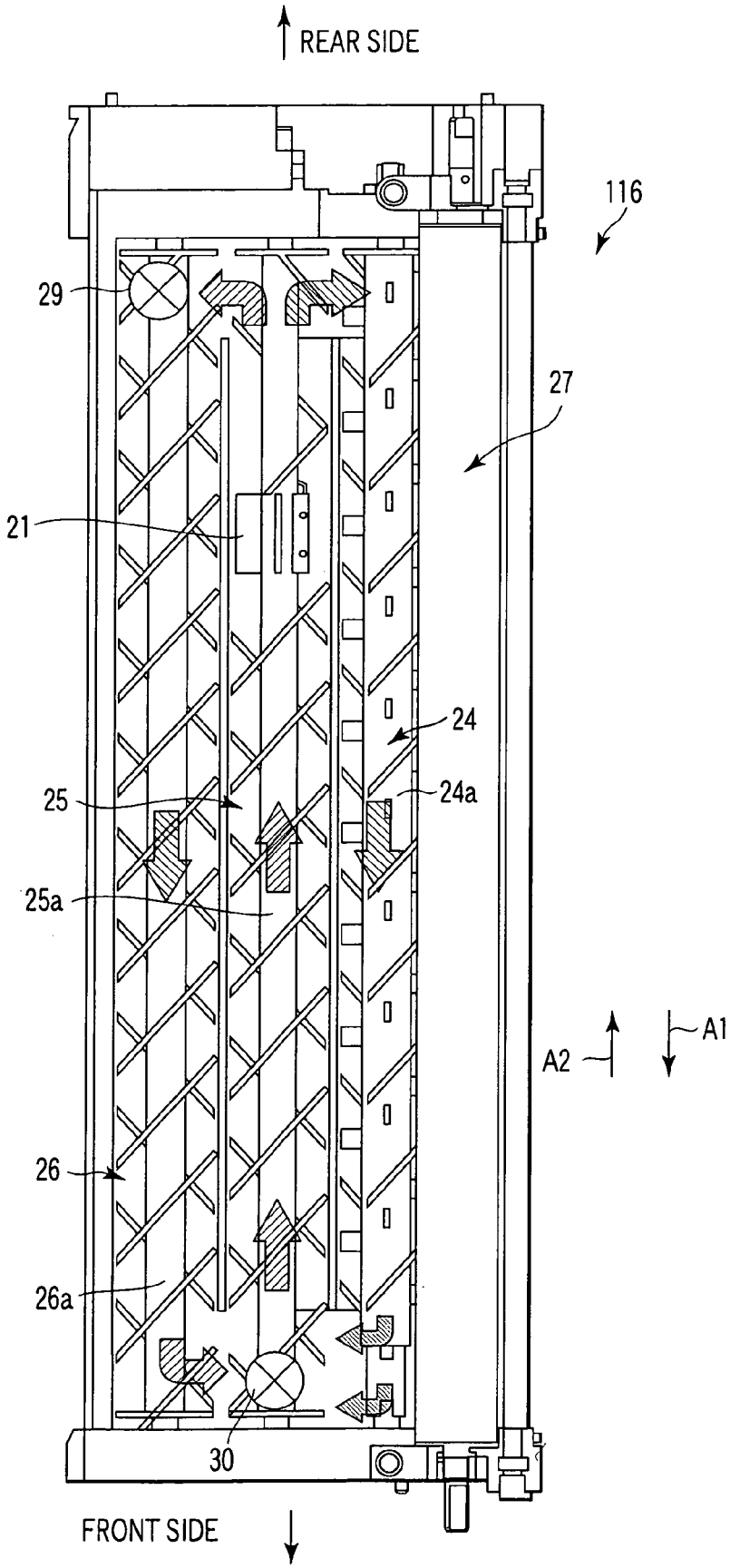
FIG. 5 schematically shows an example of the developer unit shown in FIG. 3.

Next, referring to FIG. 5, the operation of the developer unit 116 is described.

If image formation (or image formation involving image scan) is instructed through the control panel 54, the main motor driver 51 of the image forming section 102 outputs a drive signal to the main motor 55.

Upon receiving the drive signal, the main motor 55 operates to rotate the first to third mixers 24*a* to 26*a* and developing roller 27 of the developer unit 106 in predetermined directions at substantially equal speeds.

The recycle toner supplied from the recycle toner supply section 29 is stirred and conveyed in the first direction A1 in the third chamber 26, along with the developer that is already present in the third chamber 26 and the developer coming from the downstream side (rear side) of the second chamber 25. The developer stirred in the third chamber 26 on the downstream side is conveyed into the upstream-side part of the second chamber 25 where the fresh toner supply section 30 is located.

In the fresh toner supply section 30, developer coming from the third chamber 26 and first chamber 24 enters the second chamber 25. The developer, along with the fresh toner supplied from the fresh toner supply section 30, is conveyed in the second chamber 25 in the second direction A2 and stirred. Since the recycle toner is first stirred in the third chamber 26 and then stirred again in the second chamber 25 along with fresh toner, the distance of conveyance and stirring of the recycle toner is double the distance of conveyance and stirring of the fresh toner.

The developer stirred in the second chamber 25 on the downstream side is conveyed into the upstream-side part of the third chamber 26, where the recycle toner supply section 29 is located, and into the upstream-side part of the first chamber 24.

The developer conveyed to the upstream side of the first chamber 24 is further conveyed in the first chamber 24 in the first direction A1, while being stirred. The developer is then guided to the surface of the photosensitive drum 103 by the developing roller 27. As has been described above, the recycle toner is stirred and conveyed over at least the distance from the recycle toner supply section 29 to the upstream side of the first chamber 24 via the third chamber 26 and second chamber 25. This distance is longer than the minimum stirring and conveyance distance of fresh toner from the fresh toner supply section 30 to the upstream side of the first chamber 24 via the second chamber 25. The stirring and conveyance distance of the recycle toner is about double that of the fresh toner.

In the present embodiment, the stirring and conveyance distance of the recycle toner is made longer than that of the fresh toner. Thereby, the degree of stirring of the recycle toner is made greater than that of stirring of the fresh toner.

Thus, the difference in charge level between fresh toner and recycle toner can be minimized in the developer that is conveyed to the upstream side of the first chamber 24 after being stirred and conveyed in the second and third chambers 25 and 26.

In the present embodiment, it is preferable that the ratio between carrier and toner of the two-component developer in the developer container 20 be set at about 95% (% by mass):5% (% by mass). The ratio between carrier and toner is detected by the magnetic sensor 21 that is provided at a position (to be described later with reference to FIG. 5). Based on the detection result, toner is supplied from the fresh toner supply device 115.

(Second Embodiment)

Figure 6A:
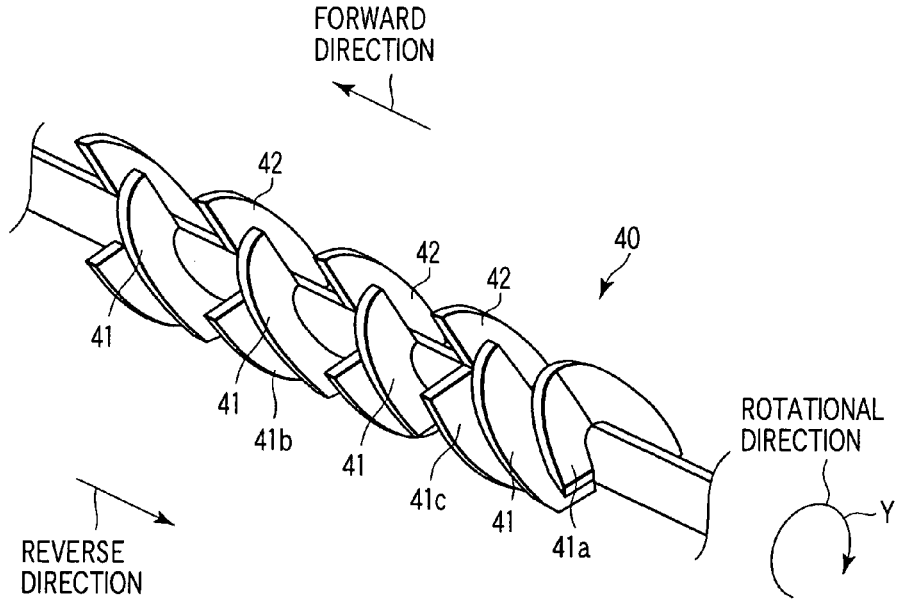
FIG. 6A and FIG. 6B schematically show other examples of the developer unit shown in FIG. 3.
Figure 6B:
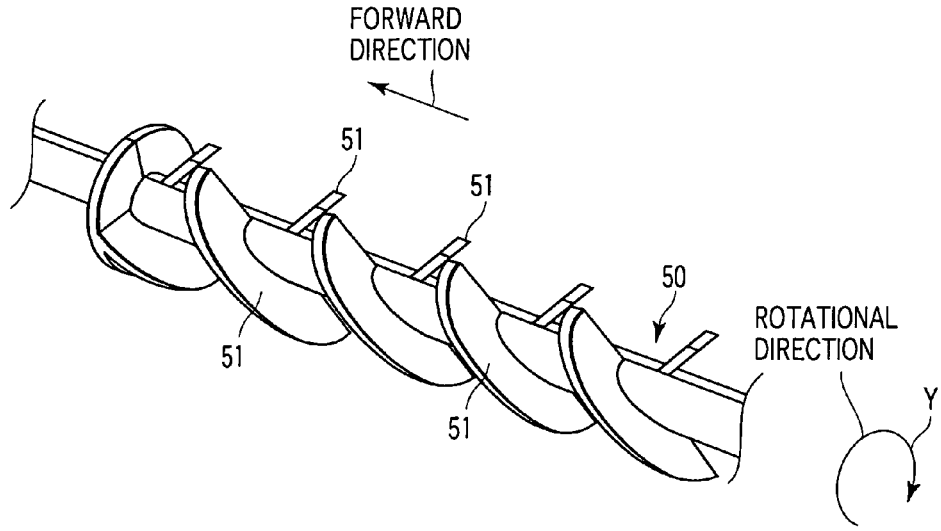

The third mixer 26*a* may be configured like a mixer 40 shown in FIG. 6A, and each of the first and second mixers 24*a* and 25*a* may be formed like a mixer 50 shown in FIG. 6B.

As is shown in FIG. 6A, the mixer 40 includes forward feed blades 41, which are rotated in a predetermined direction Y to convey developer in a forward direction, and reverse feed blades 42, which convey developer in a direction reverse to the forward direction.

The mixer 50, as shown in FIG. 6B, comprises only forward feed blades 51. Compared to the mixer 40, the time for conveying the developer in the forward direction is shorter. The mixer 40 can convey the developer at a predetermined speed in accordance with the ratio in total area between the forward feed blades 41 and reverse feed blades 42. If speed change is to be effected more finely, the area of each blade may be varied, as shown in FIG. 6A. In FIG. 6A, the size of a forward feed blade 41*a*, 41*b* is ½ of that of the forward feed blade 41, and the size of a forward feed blade 41*c* is ⅔ of that of the forward feed blades 41.

In this case, the third speed is lower than the first or second seed. For example, the third speed is ½, ⅓ or ⅙ of the first or second speed. The degree of stirring of developer in the third chamber 26 can be made greater than that of the stirring of developer in the first or second chamber.

If a sufficient axial length (distance of conveyance) of the third chamber 26 cannot be secured due to physical constraints on the apparatus, the shapes of the first to third mixers 24*a* to 26*a* may be altered. Thereby, the degree of stirring of recycle toner and the degree of stirring of fresh toner can be adjusted. Therefore, the degree of stirring of recycle toner, which is conveyed in the third chamber 26, can be made greater than that of stirring of fresh toner, and the difference in charge level between fresh toner and recycle toner can be minimized.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a first chamber including a first mixer disposed in a direction that coincides with an axial direction of an image carrying body which carries an electrostatic latent image, the first mixer stirring and conveying a developer containing at least a toner in a first direction and supplying the toner, which is charged with a predetermined potential, to the image carrying body;

a second chamber including a second mixer disposed in parallel to the first mixer, the second mixer stirring and conveying the developer in the first direction and applying a predetermined potential to the toner;

a third chamber disposed between the first chamber and the second chamber and including a third mixer disposed in parallel to the first mixer and the second mixer, the third mixer stirring and conveying the developer, which is received from downstream sides of the first and second chambers, in a second direction different from the first direction, and guiding the toner, which is charged with a predetermined potential, to at least an upstream side of the first chamber;

a recycle toner supply section that is disposed on an upstream side of the second chamber and is supplied with a toner recovered from a surface of the image carrying body; and a fresh toner supply section that is disposed on an upstream side of the third chamber and is supplied with a fresh toner.

2. The image forming apparatus according to claim 1, wherein the second mixer conveys the developer at a speed lower than a speed with which the third mixer conveys the developer.

3. An image forming apparatus comprising:

a fresh toner supply mechanism that supplies a fresh toner;

a recycle toner supply mechanism that supplies a toner recovered from a surface of an image carrying body;

stirring means for stirring and conveying the fresh toner in a first direction, which is supplied from the fresh toner supply mechanism, along a first convey path with a first length, and stirring the recycle toner, which is supplied from the recycle toner supply mechanism, along a second convey path with a second length that is greater than the first length; and the recycle toner in the second convey path being stirred and conveyed in a second direction different from the first direction, and then entering the first convey path to be stirred and conveyed in the first direction.

4. The image forming apparatus according to claim 3, wherein the length of the second convey path is double the length of the first convey path.

5. A toner stirring method comprising:

supplying a recycle toner, which is recovered from a surface of an image carrying body, to a recycle toner supply section;

stirring and conveying a fresh toner, which is supplied to a fresh toner supply section, along a first convey path with a first length in a first direction, and applying a predetermined potential to the fresh toner that is conveyed to a confluence part;

stirring and conveying the recycle toner, which is supplied to the recycle toner supply section, along a second convey path with a second length greater than the first length, the recycle toner in the second convey path being stirred and conveyed in a second direction different from the first direction, and then entering the first convey path to be stirred and conveyed in the first direction, and applying a predetermined potential to the recycle toner that is conveyed to the confluence part; and supplying the recycle toner and the fresh toner, which are conveyed to the confluence part, to the surface of the image carrying body.

6. The toner stirring method according to claim 5, wherein the length of the second convey path is double the length of the first convey path.

* * * * *